US010934653B2

(12) United States Patent
Choi

(10) Patent No.: US 10,934,653 B2
(45) Date of Patent: Mar. 2, 2021

(54) LAUNDRY TREATMENT APPARATUS

(71) Applicant: LG ELECTRONICS INC., Seoul (KR)

(72) Inventor: Younyoung Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 220 days.

(21) Appl. No.: 16/073,579

(22) PCT Filed: Jan. 20, 2017

(86) PCT No.: PCT/KR2017/000719
§ 371 (c)(1),
(2) Date: Jul. 27, 2018

(87) PCT Pub. No.: WO2017/131395
PCT Pub. Date: Aug. 3, 2017

(65) Prior Publication Data

US 2019/0032265 A1 Jan. 31, 2019

(30) Foreign Application Priority Data

Jan. 29, 2016 (KR) ..... 10-2016-0011257

(51) Int. Cl.
*D06F 33/02* (2006.01)
*D06F 33/00* (2020.01)
(Continued)

(52) U.S. Cl.
CPC ..... *D06F 33/00* (2013.01); *D06F 31/00* (2013.01); *D06F 37/04* (2013.01); *D06F 37/22* (2013.01);
(Continued)

(58) Field of Classification Search
CPC ..... D06F 39/00; D06F 39/125; D06F 34/28; D06F 23/00; D06F 29/00; D06F 35/006;
(Continued)

(56) References Cited

U.S. PATENT DOCUMENTS

2008/0130520 A1* 6/2008 Ebrom ..... D06F 33/00 370/254
2009/0113945 A1 5/2009 Kim et al.
(Continued)

FOREIGN PATENT DOCUMENTS

KR 10-0370088 1/2003
KR 10-2010-0118227 11/2010
(Continued)

OTHER PUBLICATIONS

International Search Report (with English Translation) and Written Opinion dated May 23, 2017 issued in Application No. PCT/KR2017/000719.

*Primary Examiner* — Tinsae B Ayalew
(74) *Attorney, Agent, or Firm* — Ked & Associates LLP

(57) ABSTRACT

A laundry treatment apparatus according to the present invention comprises: first and second washing units for performing washing, the first and second washing units each having a separate washing space; a first control unit which, when a command for dual washing is input through an input unit, controls the first washing unit such that the same performs washing according to a dual washing course in which the first washing unit and the second washing unit are set to perform washing at the same time, and outputs a dual control signal corresponding to the dual washing course; and a second control unit for controlling, in response to the output dual control signal, the second washing unit such that the same performs washing according to the dual washing course. The present invention efficiently performs washing
(Continued)

by using both the first and second washing units at the same time according to the dual washing course.

20 Claims, 8 Drawing Sheets

(51) Int. Cl.

| | |
|---|---|
| ***D06F 37/40*** | (2006.01) |
| ***D06F 37/30*** | (2020.01) |
| ***D06F 37/22*** | (2006.01) |
| ***D06F 39/00*** | (2020.01) |
| ***D06F 37/04*** | (2006.01) |
| ***D06F 31/00*** | (2006.01) |
| *D06F 39/12* | (2006.01) |
| *D06F 25/00* | (2006.01) |
| *D06F 34/28* | (2020.01) |
| *D06F 35/00* | (2006.01) |
| *D06F 29/00* | (2006.01) |

(52) U.S. Cl.
CPC ..... *D06F 37/30* (2013.01); *D06F 37/40* (2013.01); *D06F 39/00* (2013.01); *D06F 25/00* (2013.01); *D06F 29/00* (2013.01); *D06F 34/28* (2020.02); *D06F 35/006* (2013.01); *D06F 35/007* (2013.01); *D06F 39/125* (2013.01); *D06F 2202/12* (2013.01); *D06F 2204/10* (2013.01); *D06F 2210/00* (2013.01); *D06F 2212/02* (2013.01); *D06F 2216/00* (2013.01); *D06F 2220/00* (2013.01)

(58) Field of Classification Search
CPC ..... D06F 35/007; D06F 2204/10; D06F 2210/00; D06F 2212/02; D06F 2216/00; D06F 2220/00
USPC ..... 68/27
See application file for complete search history.

(56) References Cited

U.S. PATENT DOCUMENTS

| | | | | |
|---|---|---|---|---|
| 2010/0269266 | A1 | 10/2010 | Lee et al. | |
| 2010/0275381 | A1 | 11/2010 | Ko et al. | |
| 2011/0185511 | A1* | 8/2011 | Ryoo ..... | D06F 29/00 8/137 |

FOREIGN PATENT DOCUMENTS

| | | |
|---|---|---|
| KR | 10-2010-0118637 | 11/2010 |
| KR | 10-1154980 | 6/2012 |
| KR | 10-1435796 | 8/2014 |

* cited by examiner

LAUNDRY TREATMENT APPARATUS

CROSS-REFERENCE TO RELATED PATENT APPLICATIONS

This application is a U.S. National Stage Application under 35 U.S.C. § 371 of PCT Application No. PCT/KR2017/000719, filed Jan. 20, 2017, which claims priority to Korean Patent Application No. 10-2016-0011257, filed Jan. 29, 2016, whose entire disclosures are hereby incorporated by reference.

TECHNICAL FIELD

The present invention relates to a laundry treatment apparatus for performing washing using a plurality of washing units.

BACKGROUND ART

Generally, a laundry treatment apparatus is an apparatus that processes laundry through various operations such as washing, spin-dry, rinsing, and drying.

Such a laundry treatment apparatus includes a washing machine that washes laundry such as clothing or bedding by using the emulsifying action of the detergent, the water current action caused by the rotation of the washing tub or the laundry blade, and a mechanical force applied by the laundry blade, a dryer that applies a hot air or a cold air to dry the laundry, and a refresher that removes the crease of the clothes by applying steam. In addition, a washer-drier provides a combination of various functions.

Recently, a laundry treatment apparatus including a plurality of washing units performing washing independently has been under development, and a technology for performing washing by using a plurality of washing units at the same time has been studied.

DISCLOSURE

Technical Problem

It is an object of the present invention to provide a laundry treatment apparatus having a plurality of washing units performing washing independently of each other, and to provide a laundry treatment apparatus capable of performing washing by using a plurality of washing units simultaneously, and, when using the plurality of washing units simultaneously, enabling the plurality of washing units to start washing simultaneously and stop washing simultaneously without performing mutual communication during washing.

Technical Solution

In an aspect, there is provided a laundry treatment apparatus including: a first washing unit which performs washing; a second washing unit which has a washing space independent of the first washing unit and performs washing; an input unit which receives a dual washing command; a first control unit which, when the dual washing command is inputted through the input unit, controls the first washing unit to perform washing according to a dual washing course which is set such that the first washing unit and the second washing unit perform washing simultaneously, and outputs a dual control signal corresponding to the dual washing course; and a second control unit which controls, in response to the dual control signal outputted by the first control unit, the second washing unit to perform washing according to the dual washing course.

Advantageous Effects

According to the laundry treatment apparatus of the present invention, in the laundry treatment apparatus including a plurality of washing units that perform washing independently of each other, as it is possible to perform washing by using a plurality of washing units at the same time, washing can be performed at a time when a user desires to perform washing separately, and when the plurality of washing units are used at the same time, the plurality of washing units can start washing at the same time and finish washing at the same time without intercommunication during washing.

MODE FOR INVENTION

Hereinafter, preferred embodiments of the present invention will be described with standard to the accompanying drawings. In describing the present embodiment, the same designations and the same standard numerals are used for the same components, and further description thereof will be omitted.

Figure 1:
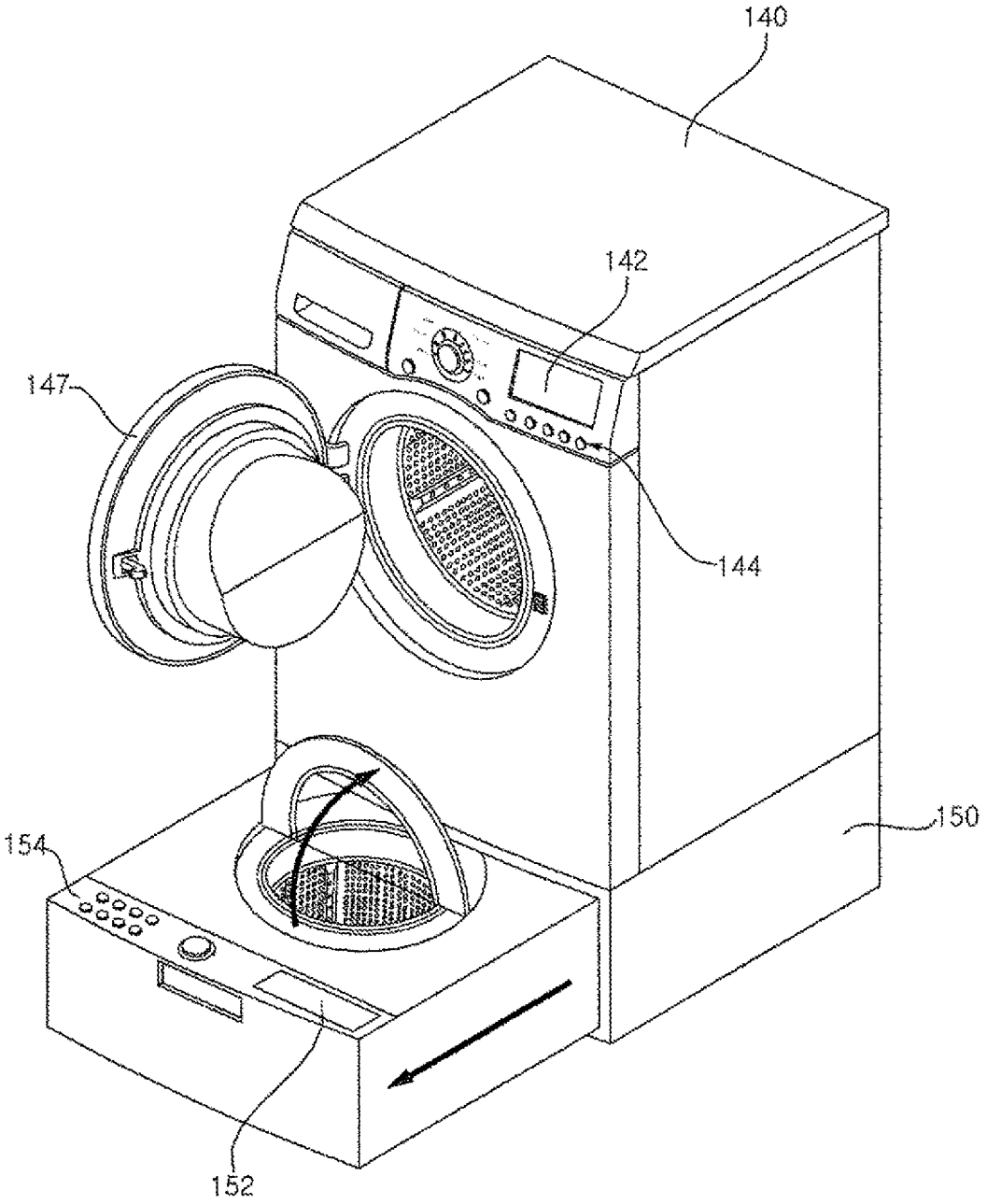
FIG. 1 is a diagram for explaining a shape of a laundry treatment apparatus according to an embodiment of the present invention.

FIG. 1 is a diagram for explaining a shape of a laundry treatment apparatus 100 according to an embodiment of the present invention.

Referring to FIG. 1, a laundry treatment apparatus 100 includes a first washing unit 140 and a second washing unit 150.

The first washing unit 140 and the second washing unit 150 are disposed vertically. The first washing unit 140 is in contact with the upper portion of the second washing unit 150. The first washing unit 140 and the second washing unit 150 can be coupled to and separated from each other, or may be an integral type which cannot be coupled to and separated from each other.

The first washing unit 140 is in the form of a front load washing machine, and the second washing unit 150 is in the form of a top load washing machine.

The second washing unit 150 has a structure in which it is slidably opened and closed in the front and rear direction like a drawer. When the second washing unit 150 is pulled to the front, the upper end of the second washing unit 150 is exposed. A second input unit 154, a second display unit 152, and a second door 157 are disposed in the upper end of the second washing unit 150.

The first washing unit 140 may include a first input unit 144, a first display unit 142 and a first door 147. The second washing unit 150 may include the second input unit 154, the second display unit 152, and the second door 157.

The first washing unit 140 and the second washing unit 150 are provided with separate input units 144 and 154 and display units 142 and 152, so that a command can be input independently of each other and an operation corresponding to the inputted command can be performed.

The first washing unit 140 and the second washing unit 150 may respectively include a water storage tank for containing water, a washing tub which accommodates laundry and is rotatably installed in the water storage tank, a motor for receiving a control command from a control unit 141, 151 and rotating the washing tub, a water supply device for supplying water into the water storage tank or the washing tub, and a draining device for draining water in the water storage tank, and perform washing independently of each other.

In FIG. 1, it is shown that the capacity of the washing tub of the first washing unit 140 is larger than the capacity of the washing tub of the second washing unit 150. However, the capacity of the washing tub of the first washing unit 140 may be equal to or smaller than the capacity of the washing tub of the second washing unit 150. The washing tub capacity of each of the washing units 140 and 150 is not limited.

The first washing unit 140 and the second washing unit 150 may be a washer-drier for simultaneously providing a washing function and a drying function.

The configurations of the above described first washing unit 140 and second washing unit 150 may be a configuration that can be provided in a general laundry treatment apparatus, and can be well known to those skilled in the art. Therefore, a detailed description thereof will be omitted.

Figure 2:
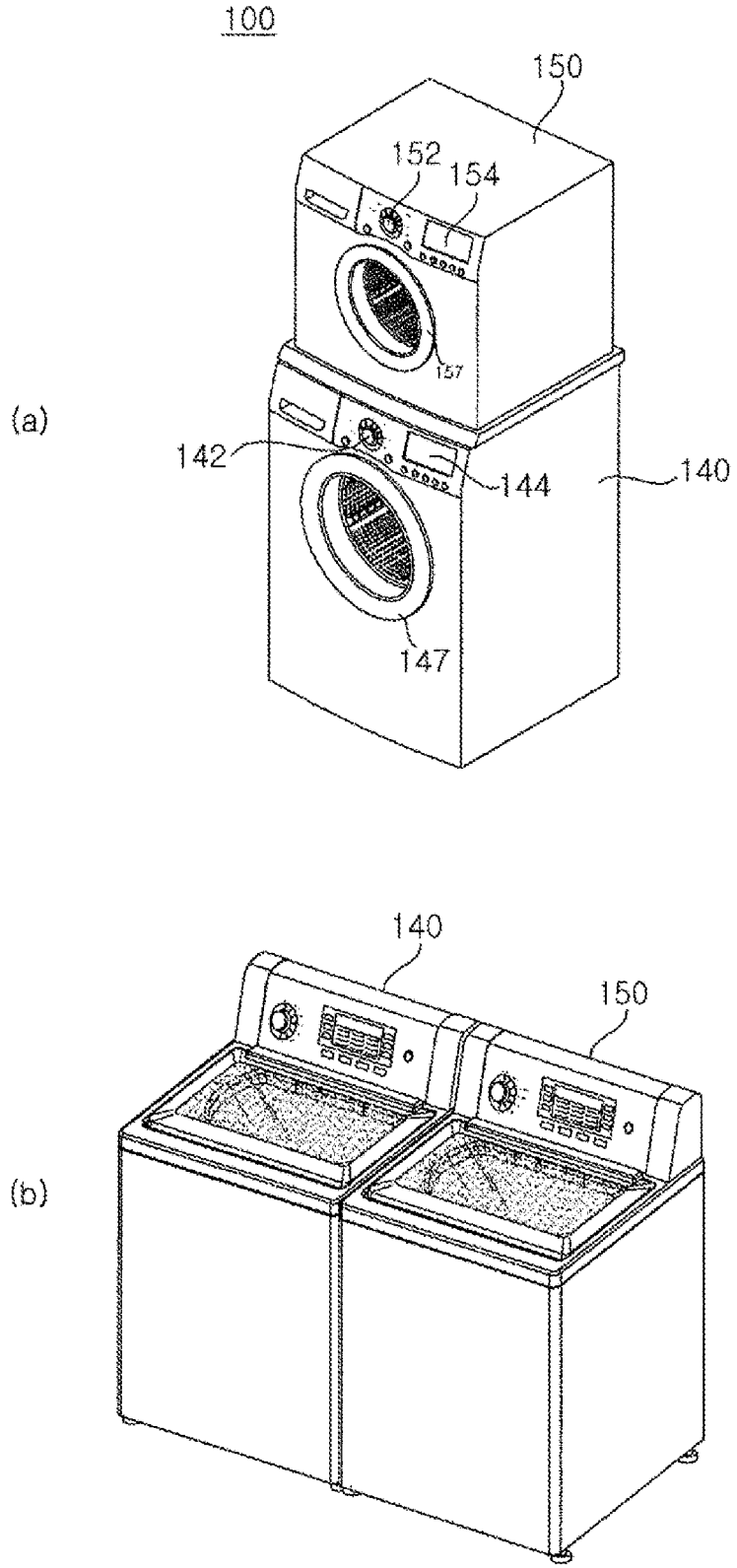
FIG. 2 is a diagram for explaining a shape of a laundry treatment apparatus according to another embodiment of the present invention.

FIG. 2 is a diagram for explaining a shape of a laundry treatment apparatus according to another embodiment of the present invention.

Referring to FIG. 2A, both the first washing unit 140 and the second washing unit 150 may be in the form of a front load washing machine. In addition, the second washing unit 150 may be disposed above the first washing unit 140.

Referring to FIG. 2B, both the first washing unit 140 and the second washing unit 150 may be in the form of a top load washing machine. In addition, the second washing unit 150 may be disposed above the first washing unit 140. In addition, the first washing unit 140 and the second washing unit 150 may be disposed laterally.

The laundry treatment apparatus 100 may include the first washing unit 140 and the second washing unit 150 which are washing spaces independently from each other, and the first washing unit 140 and the second washing unit 150 may be spaced apart at a certain interval.

The shape of the first washing unit 140 and the second washing unit 150 or the disposition of the first washing unit 140 and the second washing unit 150 are not limited.

Figure 3:
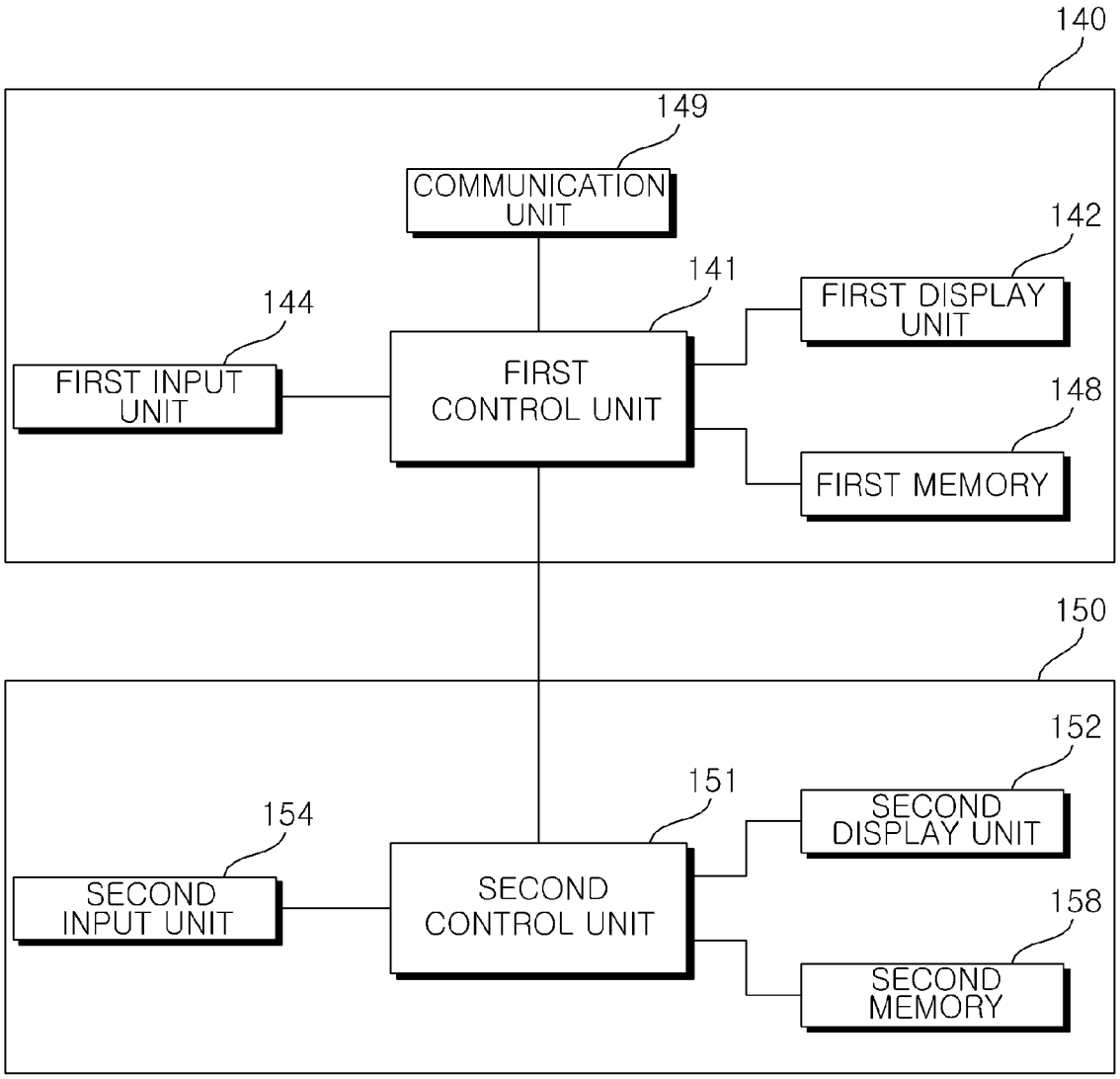
FIG. 3 is a block diagram illustrating a configuration of a laundry treatment apparatus according to an embodiment of the present invention.

FIG. 3 is a block diagram illustrating a configuration of a laundry treatment apparatus according to an embodiment of the present invention.

The first washing unit 140 includes a first input unit 144, a first display unit 142, a first control unit 141 for controlling the overall operation of the first washing unit 140, a first memory 148 for storing at least one dual washing course and a first washing unit course, and a communication unit 149 for performing communication with a preset network.

The second washing unit 150 includes a second input unit 154, a second display unit 152, a second control unit 151 for controlling the overall operation of the second washing unit 150, and a second memory 158 for storing at least one dual washing course and a second washing unit course.

The input unit 144, 154 of the laundry treatment apparatus 100 includes the first input unit 144 and the second input unit 154. The input unit 144, 154 may be the first input unit 144 or the second input unit 154.

The input unit 144, 154 includes an input means such as at least one bundle switch, and a touch pad, and the setting related to operation of each washing unit such as power input, washing course selection, and wash water temperature setting is inputted through the input unit 144, 154.

Hereinafter, the input unit 144, 154 of the present invention will be described with reference to the case of the first input unit 144, but the same can be applied to the second input unit 154 as well.

The first input unit 144 receives a dual washing command. The first input unit 144 may have a separate key for inputting the dual washing command.

The display unit 142, 152 of the laundry treatment apparatus 100 includes the first display unit 142 and the second display unit 152. The display unit 142, 152 includes the first display unit 142 or the second display unit 152.

On the display unit 142, 152, the operation setting or operation state of each washing unit inputted by the input unit 144, 154 is displayed. The display unit 142, 152 may be a liquid crystal display (LCD), a light emitting diode (LED), or an organic light emitting diode (OLED). The display unit 142, 152 may be a means by which an image can be displayed, and is not limited thereto.

Hereinafter, the display unit 142, 152 of the present invention will be described with reference to the case of the first display unit 142, but the same can be applied to the second display unit 152 as well.

The first control unit 141 controls the first washing unit 140 in response to a control command inputted through the first input unit 144. In addition, the first control unit 141 controls the first display unit 142 to display the operation setting of the first washing unit 140 inputted by the first input unit 144 or the operation state of the first washing unit 140. The second control unit 151 performs an operation corresponding to the first control unit 141, in the second washing unit 150. Hereinafter, the operation of the second control unit 151 corresponding to the first control unit 141 will not be described separately.

When a dual washing command is inputted through the first input unit 144, the first control unit 141 controls the first washing unit 140 to perform washing according to a dual washing course that is set in such a manner that the first washing unit 140 and the second washing unit 150 perform washing simultaneously, and outputs a dual control signal corresponding to the dual washing course to the second control unit 151. The dual control signal includes information on the dual washing course performed by the first washing unit 140 and the second washing unit 150.

The dual control signal is a signal that the first control unit 141 outputs to the second control unit 151 when the dual washing command is inputted, and the dual control signal includes information on the dual washing course performed by the second washing unit 150 so that the signal is not outputted again until the end of the dual washing course once it is outputted.

The second control unit 151 receives the dual control signal from the first control unit 141, and controls the second washing unit 150 to perform washing according to the dual washing course corresponding to the transmitted dual control signal. Specifically, when the dual control signal is transmitted from the first control unit 141, the second control unit 151 controls the second washing unit 150 according to information on the dual washing course included in the dual control signal.

The memory 148, 158 stores at least one dual washing course. The memory 148, 158 may be any means which can store data, and is not limited thereto.

The memory 148, 158 includes the first memory 148 and the second memory 158. Accordingly, the memory 148, 158 of the present invention may be the first memory 148 or the second memory 158. Hereinafter, the memory 148, 158 will be described with reference to the case of the first memory 148, but the same can be applied to the case of the second memory 158 as well.

When one of the at least one dual washing course stored in the first memory 148 is selected through the first input unit 144, the first control unit 141 transmits the dual control signal corresponding to the selected dual washing course to the second control unit 151, and controls the first washing unit 140 to perform washing according to the selected dual washing course. The second control unit 151 receives the dual control signal from the first control unit 141, and controls the second washing unit 151 to perform washing according to the dual washing course corresponding to the dual control signal.

The dual washing course is a washing course which is a combination of a first washing unit course which is a washing course performed by the first washing unit 140 and a second washing unit course which is a washing course performed by the second washing unit 150.

Accordingly, the dual washing course may be a washing course set such that the first washing unit 140 and the second washing unit 150 start washing simultaneously, a washing course set such that the first washing unit 140 and the second washing unit 150 finish washing simultaneously, or a washing course set such that the first washing unit 140 and the second washing unit 150 start washing simultaneously and finish washing simultaneously.

In addition, the dual washing course is a washing course composed of a plurality of preset processes performed by the first washing unit 140 and a plurality of preset processes performed by the second washing unit 150. Since the order of the plurality of processes respectively performed by the first washing unit 140 or the second washing unit 150 and the performance time of each process are previously set, the first washing unit 140 and the second washing unit 150 are not necessary to check mutual operation through communication during washing.

The communication unit 149 communicates with a preset network, and the first control unit 141 can download the dual washing course from the preset network through the communication unit 149. The first control unit 141 stores the downloaded dual washing course in the memory 148.

The preset network may be the Internet, an intranet, or the like, and may be an accessible network, but is not limited thereto.

A newly generated dual washing course can be uploaded to the preset network in addition to the existing uploaded dual washing course, and the first control unit 141 can download the newly uploaded dual washing course to the preset network.

The first control unit 141 may display at least one dual washing course stored in the memory 148 on the display unit 142, control the first washing unit 140 according to the dual washing course selected through the first input 144 from among at least one dual washing course, and output the dual control signal to operate the second washing unit 150.

Figure 4:
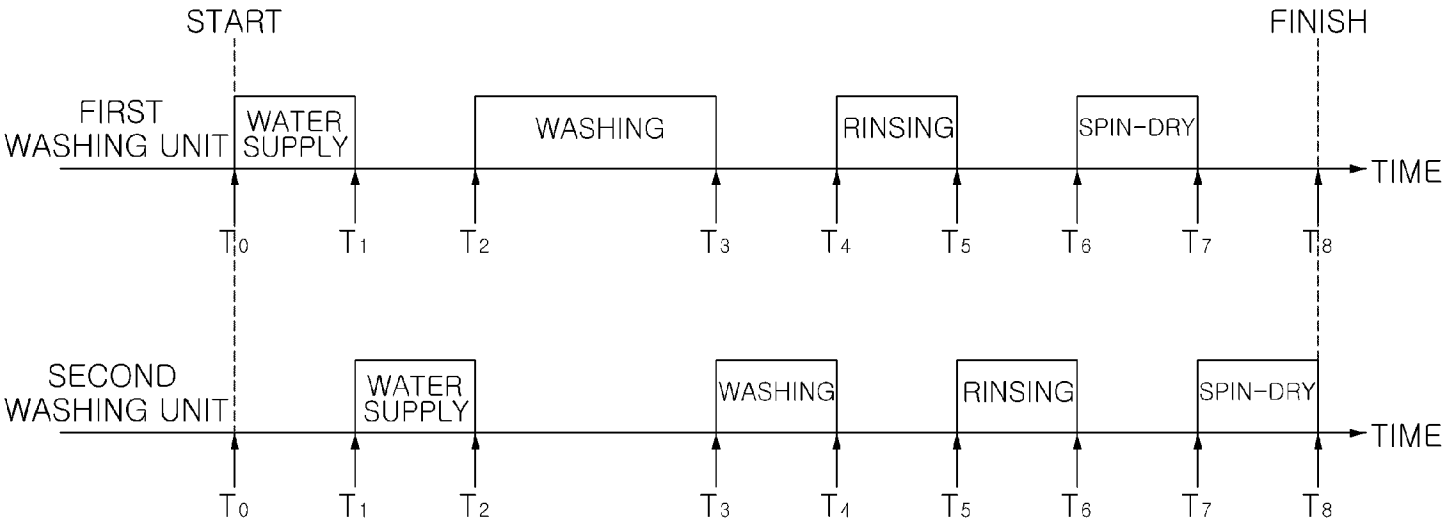
FIG. 4 is a diagram for explaining a dual washing course performed by a laundry treatment apparatus according to an embodiment of the present invention.

FIG. 4 is a diagram for explaining a dual washing course performed by a laundry treatment apparatus according to an embodiment of the present invention.

According to the embodiment of FIG. 4, the dual washing course is a washing course set such that the process of the first washing unit 140 and the process of the second washing unit 150 are not simultaneously performed.

If the processes performed by the first washing unit 140 and the second washing unit 150 are a water supply process, a washing process, a rinsing process, and a spin-dry process, respectively, the dual washing course of the embodiment of FIG. 4 is set such that all processes are performed independently.

When the laundry treatment apparatus 100 performs washing according to the dual washing course, the first control unit 141 transmits a dual control signal containing information on the dual washing course at the start of washing, and controls the first washing unit 140 to perform the water supply process from T0 to T1.

The second control unit 151 controls the second washing unit 150 to wait from T0 to T1 according to the dual washing course information contained in the received dual control signal.

From T1 to T2, the first control unit 141 controls the first washing unit 140 to wait after completing the water supply process, and the second control unit 151 controls to perform the water supply process of the second washing unit 150.

From T2 to T3, the first control unit 141 controls the first washing unit 140 to perform washing, and the second control unit 151 controls the second washing unit 150 to wait after completing the water supply process.

From T3 to T4, the first control unit 141 controls the first washing unit 140 to wait after completing the washing process, and the second control unit 151 controls the second washing unit 150 to perform the washing process.

From T4 to T5, the first control unit 141 controls the first washing unit 140 to perform the rinsing process, and the second control unit 151 controls the second washing unit 150 to wait after completing the washing process.

From T5 to T6, the first control unit 141 controls the first washing unit 140 to wait after completing the rinsing process, and the second control unit 151 controls the second washing unit 150 to perform the rinsing process.

From T6 to T7, the first control unit 141 controls the first washing unit 140 to perform the spin-dry process, and the second control unit 151 controls the second washing unit 150 to wait after completing the rinsing process.

From T7 to T8, the first control unit 141 controls the first washing unit 140 to wait after completing the spin-dry process, and the second control unit 151 controls the second washing unit 150 to perform the spin-dry process.

Figure 5:
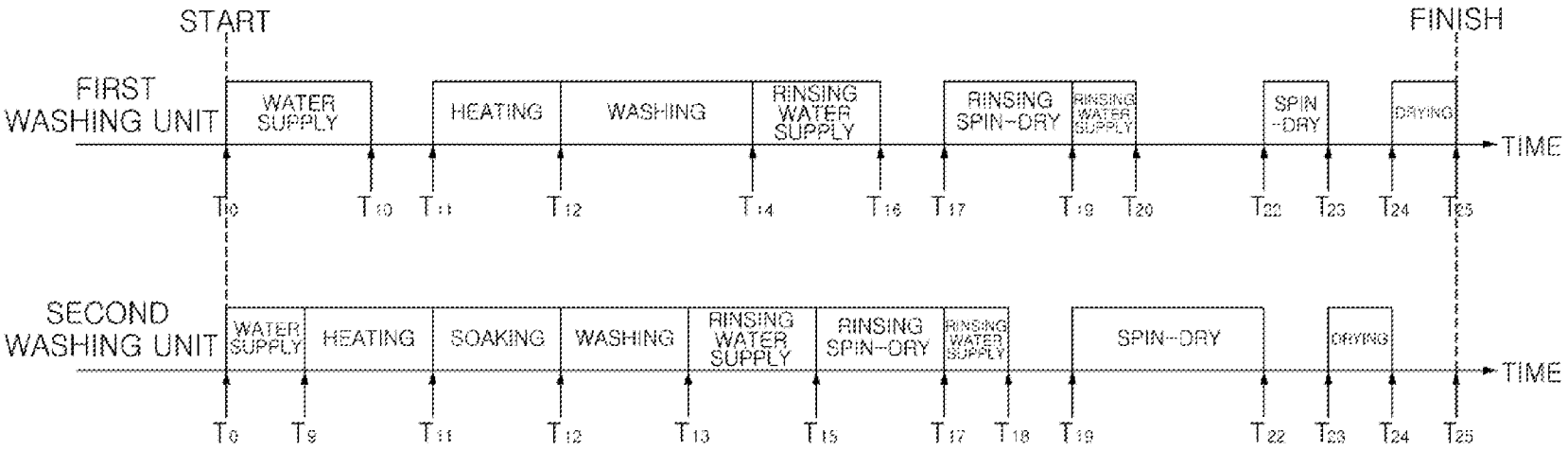
FIG. 5 is a diagram for explaining a dual washing course performed by a laundry treatment apparatus according to another embodiment of the present invention.

FIG. 5 is a diagram for explaining a dual washing course performed by a laundry treatment apparatus according to another embodiment of the present invention.

According to the embodiment of FIG. 5, the dual washing course is a washing course set such that the spin-dry process, the drying process, or the heating process of one of the first washing unit 140 and the second washing unit 150 is not performed simultaneously with the spin-dry process, the heating process, or the drying process of the other.

In the case of the water supply process, the washing process, and a rinsing water supply process of supplying rinsing water, even if the above processes are simultaneously performed in the first and second washing units 140 and 150, there is little probability of damage due to excessive power consumption or vibration. On the other hand, when the first washing unit 140 and the second washing unit 150 simultaneously perform the spin-dry process, a large vibration may occur, so that the laundry treatment apparatus 100 can be damaged. When the drying process or the heating process are simultaneously performed, there is a probability that instantaneous power consumption is sharply increased and power is blocked.

The dual washing course of the present embodiment is a washing course set such that the spin-dry, drying, and heating processes are not performed simultaneously in the first washing unit 140 and the second washing unit 150.

At T0, the first control unit 141 starts the water supply process according to the dual washing course, and transmits a dual control signal corresponding to the dual washing course to the second control unit 151. The second control unit 151 starts the water supply process according to the dual washing course corresponding to the transmitted dual control signal.

When the water supply process of the second washing unit 150 is completed at T9, the second control unit 151 controls the second washing unit 150 to perform the heating process for heating the supplied water.

Since the heating process of the second washing unit 150 and the water supply process of the first washing unit 140 can be performed simultaneously, the first control unit 141 controls to perform the water supply process of the first washing unit 140 from T9 to T10.

When the water supply process of the first washing unit 140 is completed at T10, the first control unit 141 enables the first washing unit 140 to wait until the heating process of the second washing unit 150 is completed.

After completing the heating process of the second washing unit 150 at T11, the second controller 151 enables the second washing unit 150 to wait to perform soaking, and the first control unit 141 controls the first washing unit 140 to perform the heating process.

At T12, the first control unit 141 completes the heating process of the first washing unit 140 and controls the first washing unit 140 to perform washing. The second control unit 151 controls the second washing unit 150 to perform washing. This is because even if the first washing unit 140 and the second washing unit 150 perform the washing process at the same time, there is a low probability of damage due to excessive power consumption or vibration.

At T13, the second control unit 151 completes the washing process of the second washing unit 150 and controls the second washing unit 150 to perform the rinsing water supply process. The washing process and the rinsing process may be performed simultaneously by other washing unit.

At T14, the first control unit 141 completes the washing process of the first washing unit 140 and controls the first washing unit 140 to perform the rinsing water supply process.

At T15, the second control unit 151 completes the rinsing water supply process of the second washing unit 150 and controls the second washing unit 150 to perform the rinsing spin-dry process. When the first washing unit 140 and the second washing unit 150 simultaneously perform the spin-dry process, the laundry treatment apparatus 100 may be damaged. However, the rinsing water supply process and the rinsing spin-dry process may be simultaneously performed by other washing unit. The rinsing process includes the rinsing spin-dry process and the rinsing water supply process, and the rinsing spin-dry process can generate a large vibration as in the spin-dry process. Thus, it is treated in the same manner as the spin-dry process.

At T16, the first control unit 141 completes the rinsing water supply process of the first washing unit 140 and controls the first washing unit 140 to wait. This is, because the rinsing spin-dry process of the second washing unit 150 is set until T17, to allow the first washing unit 140 and the second washing unit 150 not to simultaneously perform the spin-dry process.

At T17, the second control unit 151 completes the rinsing spin-dry process of the second washing unit 150 and controls the rinsing water supply process to be performed. The first control unit 141 controls the first washing unit 140 to perform the rinsing spin-dry process.

At T18, the second control unit 151 completes the rinsing water supply process of the second washing unit 150 and controls the second washing unit 150 to wait. This is, because the rinsing spin-dry process of the first washing unit 140 is set until T19, to allow the first washing unit 140 and the second washing unit 150 not to simultaneously perform the spin-dry process.

At T19, the first control unit 141 completes the rinsing spin-dry process of the first washing unit 140 and controls the first washing unit 140 to perform the rinsing water supply process. The second control unit 151 controls the second washing unit to perform the spin-dry process.

At T21, the first control unit 141 completes the rinsing water supply process of the first washing unit 140 and controls the first washing unit 140 to wait until T22.

From T22 to T23, the second control unit 151 completes the spin-dry process of the second washing unit 150 and controls the second washing unit 150 to wait, and the first control unit 141 controls the first washing unit 140 to perform the spin-dry process.

From T23 to T24, the first control unit 141 completes the spin-dry process of the first washing unit 140 and controls the first washing unit 140 to wait, and the second control unit 151 controls the second washing unit 150 to perform the drying process. This is because, when the first washing unit 140 and the second washing unit 150 perform the drying and spin-dry processes simultaneously, there is a probability of the excessive power consumption and the damage to the laundry treatment apparatus 100.

From T24 to T25, the first control unit 141 controls the first washing unit 140 to perform the drying process, and the second control unit 151 controls the second washing unit 150 to complete the drying process and wait. This is because there is a probability of excessive power consumption when the first washing unit 140 and the second washing unit 150 perform the drying process simultaneously.

Figure 6:
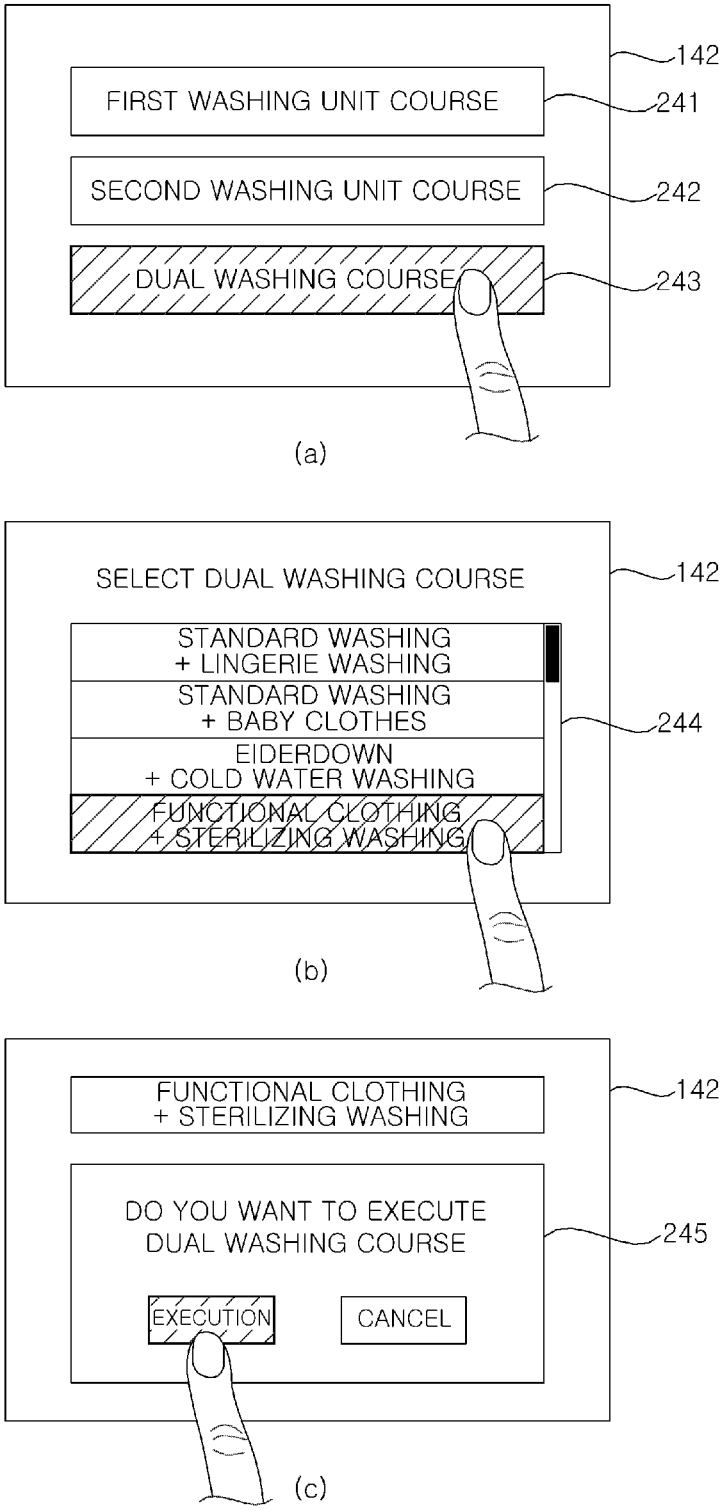
FIG. 6 is a diagram for explaining a process of selecting a dual washing course in a laundry treatment apparatus according to an embodiment of the present invention.

FIG. 6 is a diagram for explaining a process of selecting a dual washing course in a laundry treatment apparatus according to an embodiment of the present invention.

Referring to FIG. 6A, when the laundry treatment apparatus 100 is turned on, the first control unit 141 displays a first washing unit course selection key 241, a second washing unit course selection key 242, and a dual washing course selection key 243 on the display unit 142. The display unit 142 may be a touch screen integrated with the input unit 144.

Referring to FIG. 6B, the first control unit 141 displays a dual washing course selection window 244 on which at least one dual washing course stored in the memory 148, 158 on the display unit 142, in response to the touch input for the dual washing course selection key 243.

The dual washing course selection window 244 displays at least one selectable dual washing course. For example, the selectable dual washing course may be composed of a standard washing course and a lingerie washing course, may be composed of a standard washing course and a baby clothes washing course, may be composed of a eiderdown washing course and a cold water washing course, or may be composed of a functional clothing washing course or a sterilizing washing course. In addition, the washing course forming the dual washing course may be a speed washing course, a high-grade clothes washing course, or the like, and may be a washing course that can be performed by the first washing unit 140 or the second washing unit 150, and is not limited thereto. One of the two washing courses forming the dual washing course is performed by the first washing unit 140, and the other is performed by the second washing unit 150.

Referring to FIG. 6C, the first control unit 141 displays a dual washing course execution window 245 for receiving the execution of the selected dual washing course on the display unit 142, in response to the touch input for one of the at least one dual washing courses displayed on the dual washing course selection window 244. In addition, the first control unit 141 may display the selected dual washing course in the upper end of the dual washing course execution window 245.

When an execution key displayed on the dual washing course execution window 245 is selected, the first control unit 141 controls the first washing unit 140 according to the selected dual washing course and outputs a dual control signal. When a cancel key displayed on the dual washing course execution window 245 is selected, the first control unit 141 displays the dual washing course selection window 244 on the display unit 142 again.

According to another embodiment of the present invention, when the first washing unit course, which is a washing course performed by the first washing unit 140, is inputted through the first input unit 144, when the second washing unit course, which is a washing course performed by the second washing unit 150, is inputted through the second input unit 154, and when a dual washing course composed of the inputted first washing unit course and second washing unit course exists in the memory 148, 158, the first control unit 141 controls the first washing unit 140 to perform washing according to the dual washing course and outputs a dual control signal corresponding to the dual washing course to the second control unit 151, so that the second control unit 151 controls the second washing unit 150 according to the dual washing course.

Figure 7:
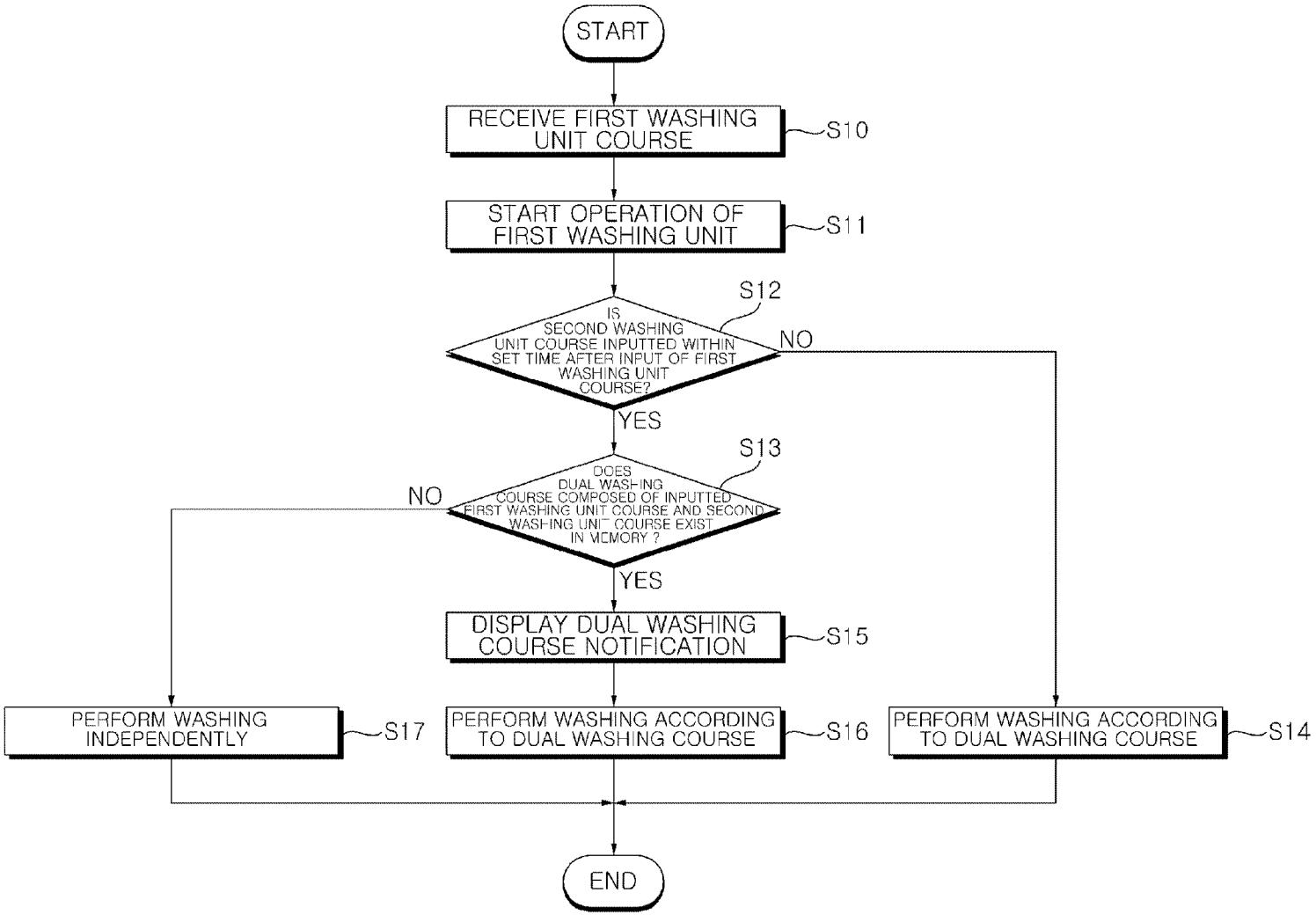
FIG. 7 is a flowchart illustrating an operation process of a laundry treatment apparatus according to another embodiment of the present invention.

FIG. 7 is a flowchart illustrating an operation process of a laundry treatment apparatus according to another embodiment of the present invention.

The first control unit 141 receives the input of the first washing unit course, which is a washing course performed by the first washing unit, through the first input unit 144 (S10), and controls the first washing unit 140 to operate according to the inputted first washing unit course (S11).

The first control unit 141 determines whether the second washing unit course is inputted through the second input unit 154 within a set time after the first washing unit course is inputted through the first input unit 144 (S12). If it is determined that the second washing unit course is not inputted, or the second washing unit course is inputted after the set time has elapsed from the input of the first washing unit course, the first control unit 141 controls the first washing unit 140 to continuously performs washing according to the first washing unit course (S14).

If it is determined that the second washing unit course is inputted through the second input unit 154 within the set time after the first washing unit course is inputted through the first input unit 144, the first control unit 141 determines whether the dual washing course composed of the inputted first washing unit course and second washing unit course exists among at least one dual washing course stored in the first memory 148 (S13).

If it is determined that the dual washing course composed of the inputted first washing unit course and second washing unit course exists among at least one dual washing course stored in the first memory 148, the first control unit 141 displays a dual washing course notification on the first display unit 142 to notify that the dual washing course can be performed (S15).

When a dual washing command is inputted through the first input unit 144 in response to the dual washing course notification, the first control unit 141 controls the first washing unit 140 to perform washing according to the dual washing course, and outputs a dual control signal corresponding to the dual washing course to the second control unit 151, so that the second control unit 151 controls the second washing unit 150 according to the dual washing course (S16).

If it is determined that the dual washing course composed of the inputted first washing unit course and second washing unit course does not exist among at least one dual washing course stored in the first memory 148, the first control unit 141 controls the first washing unit 140 to perform washing independently of the second washing unit 150 (S17). At this time, the second control unit 151 controls the second washing unit 150 according to the inputted second washing unit course.

According to another embodiment of the present invention, before completing the water supply process after the first washing unit 140 starts washing as the first washing unit course is inputted, when the second washing unit course is inputted through the second input unit 154, and when the dual washing course composed of the inputted first washing unit course and second washing unit course exists in the memory 148, 158, the first control unit 141 controls the first washing unit 140 to perform washing according to the dual washing course, and outputs the dual control signal corresponding to the dual washing course to the second control unit 151 so that the second control unit 151 controls the second washing unit 150 according to the dual washing course.

Figure 8:
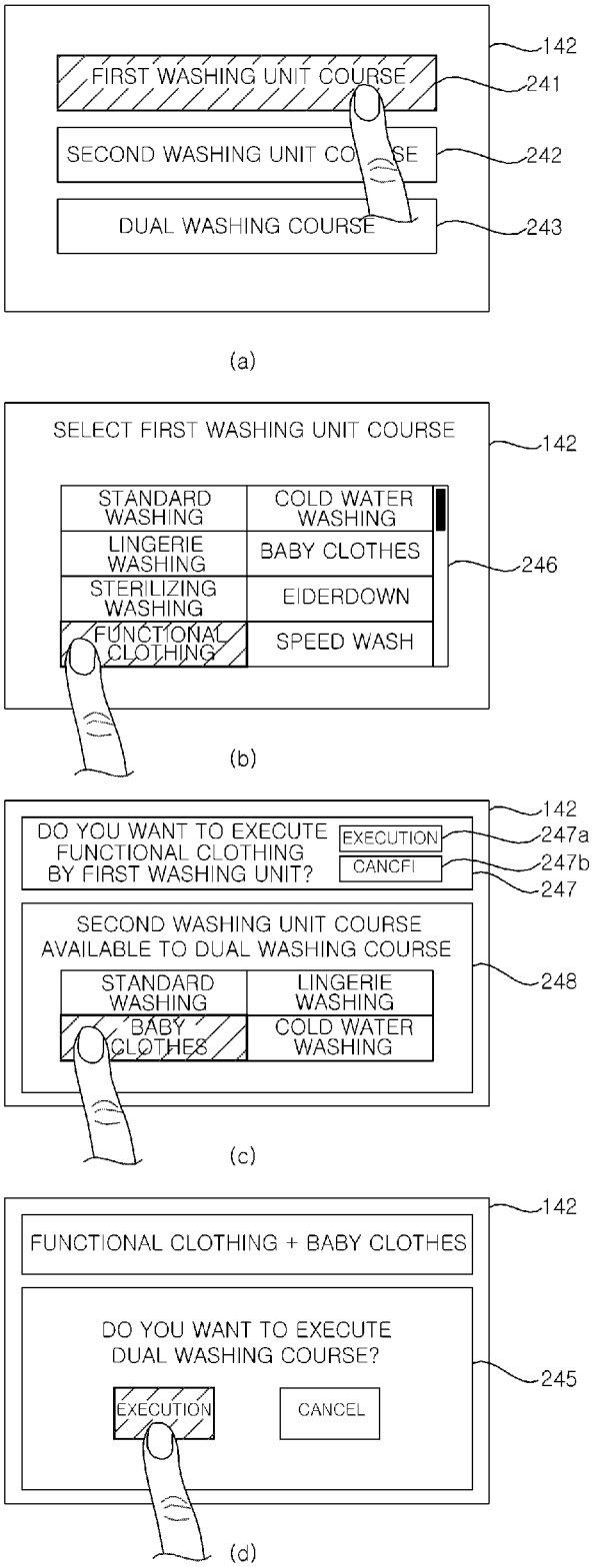
FIG. 8 is a diagram for explaining a process of selecting a dual washing course by inputting a first washing unit course and a second washing unit course according to an embodiment of the present invention.

FIG. 8 is a diagram for explaining a process of selecting a dual washing course by inputting a first washing unit course and a second washing unit course according to an embodiment of the present invention.

Referring to FIG. 8A, when the laundry treatment apparatus 100 is turned on, the first control unit 141 enables the display unit 142 to display the first washing unit course selection key 241, the second washing unit course selection key 242, and the dual washing course selection key 243. In this case, the display unit 142 may be a touch screen integrated with the input unit 144.

Referring to FIG. 8B, the first control unit 141 controls the first display unit 142 to display a first washing unit course selection window 246, in response to the touch input for the first washing unit course selection key 241. The first washing unit course selection window 246 includes at least one first washing unit course that is selectable.

Referring to FIG. 8C, the first control unit 141 displays a first washing unit course execution window 247 and a second washing unit course selection window 248 on the first display unit 142, in response to the touch input for one of at least one selectable first washing unit course displayed on the first washing unit course selection window 246.

The first washing unit course execution window 247 includes a text for checking whether the selected first washing unit course is executed, a first washing unit course execution key 247*a*, and a first washing unit course cancel key 247*b*.

The first control unit 141 controls the first washing unit 140 to perform washing according to the selected first washing unit course, in response to the touch input for the first washing unit course execution key 247*a*.

The first control unit 141 enables the first display unit 142 to display the first washing unit course selection window 246 again, in response to the touch input for the first washing unit course cancel key 247*b*.

The second washing unit course selection window 248 includes at least one second washing unit course that can be combined with the selected first washing unit course. The combination of the second washing unit course with the selected first washing unit course means that the dual washing course composed of the selected first washing unit course and second washing unit course exists among at least one dual washing course stored in the first memory 148.

Accordingly, the first control unit 141 searches the dual washing course including the selected first washing unit course among at least one dual washing course stored in the first memory 148, and displays the second washing unit course included in a corresponding dual washing course on the second washing unit course selection window 248.

Referring to FIG. 8D, the first control unit 141 displays, on the display unit 142, the dual washing course execution window 245 which receives the execution of the dual washing course composed of the selected first washing unit course and the second washing unit course, in response to the touch input for one of at least one second washing unit course displayed on the second washing unit course selection window 248. In addition, the first control unit 141 may display a dual washing course to be executed on the upper end of the dual washing course execution window 245.

When the execution key displayed in the dual washing course execution window 245 is selected, the first control unit 141 controls the first washing unit 140 according to the dual washing course composed of the selected first washing unit course and second washing unit course, and outputs a dual control signal. When the cancel key displayed on the dual washing course execution window 245 is selected, the first control unit 141 displays the first washing unit course execution window 247 and the second washing unit course selection window 248 on the display unit 142 again.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, the scope of the present invention is not construed as being limited to the described embodiments but is defined by the appended claims as well as equivalents thereto.

The invention claimed is:

1. A laundry treatment apparatus comprising:

a first washing unit which performs washing;

a second washing unit which has a washing space independent of the first washing unit and performs washing;

an input unit which receives a dual washing command;

a first control unit which, when the dual washing command is inputted through the input unit, controls the first washing unit to perform washing according to a dual washing course which is set such that the first washing unit and the second washing unit perform washing simultaneously, and outputs a dual control signal corresponding to the dual washing course; and a second control unit which controls, in response to the dual control signal outputted by the first control unit, the second washing unit to perform washing according to the dual washing course.

2. The laundry treatment apparatus of claim 1, wherein the dual washing course is a washing course which is set such that the first washing unit and the second washing unit start washing simultaneously.

3. The laundry treatment apparatus of claim 1, wherein the dual washing course is a washing course which is set such that the first washing unit and the second washing unit finish washing simultaneously.

4. The laundry treatment apparatus of claim 1, wherein the dual washing course is a washing course comprising a plurality of preset processes performed by the first washing unit and a plurality of preset processes performed by the second washing unit.

5. The laundry treatment apparatus of claim 1, wherein the dual washing course is a washing course which is set such that a process of the first washing unit and a process of the second washing unit are not simultaneously performed.

6. The laundry treatment apparatus of claim 1, wherein the dual washing course is a washing course which is set such that a spin-dry process, a drying process, or a heating process of any one of the first washing unit and the second washing unit is not performed simultaneously with a spin-dry process, a drying process, or a heating process of the other washing unit.

7. The laundry treatment apparatus of claim 1, further comprising a memory which stores at least one dual washing course, wherein, when one of at least one dual washing course stored in the memory is selected through the input unit, the first control unit controls the first washing unit to perform washing according to the selected dual washing course, wherein the second control unit controls the second washing unit to perform washing according to the selected dual washing course.

8. The laundry treatment apparatus of claim 7, further comprising a display unit, wherein the first control unit displays at least one dual washing course stored in the memory on the display unit, and, when one dual washing course is selected through the input unit, displays the selected dual washing course on the display unit.

9. The laundry treatment apparatus of claim 7, further comprising a communication unit for performing communication with a preset network;

wherein the first control unit downloads the dual washing course from the preset network through the communication unit, and stores the downloaded dual washing course in the memory.

10. The laundry treatment apparatus of claim 1, further comprising:

a display unit; and a memory which stores at least one dual washing course, wherein the first control unit displays at least one selectable first washing unit course on the display unit, and, when one first washing unit course is selected through the input unit, displays at least one second washing unit course that can be combined with the selected first washing unit course based on at least one dual washing course stored in the memory on the display unit.

11. The laundry treatment apparatus of claim 10, wherein the first control unit, when one second washing unit course is selected through the input unit among at least one second washing unit course displayed on the display unit, controls the first washing unit to perform washing according to a dual washing course composed of the selected second washing unit course and the selected first washing unit course among at least one dual washing course stored in the memory, wherein the second control unit controls the second washing unit to perform washing according to the dual washing course.

12. The laundry treatment apparatus of claim 1, further comprising a memory which stores at least one dual washing course, wherein the input unit comprises:

a first input unit for receiving a first washing unit course; and a second input unit for receiving a second washing unit course, wherein, when a first washing unit course is inputted through the first input unit, when a second washing unit course is inputted through the second input unit, and when a dual washing course composed of the inputted first washing unit course and the inputted second washing unit course exists in the memory, the first control unit controls the first washing unit to perform washing according to the dual washing course, and outputs a dual control signal corresponding to the dual washing course.

13. The laundry treatment apparatus of claim 12, wherein, when an interval between a time when the first washing unit course is inputted and a time when the second washing unit course is inputted is equal to or shorter than a set time interval, and when a dual washing unit course composed of the inputted first washing unit course and the inputted second washing unit course exists in the memory, the first control unit controls the first washing unit to perform washing according to the dual washing course, and outputs a dual control signal corresponding to the dual washing course.

14. The laundry treatment apparatus of claim 12, wherein, before completing a water supply process after the first washing unit starts washing as the first washing unit course is inputted, when the second washing unit course is inputted through the second input unit, and when a dual washing course composed of the first washing unit course and the second washing unit course exists in the memory, the first control unit controls the first washing unit to perform washing according to the dual washing course, and outputs a dual control signal corresponding to the dual washing course.

15. The laundry treatment apparatus of claim 12, wherein, when a dual washing course composed of the inputted first washing unit course and the inputted second washing unit course exists in the memory, and when a dual washing command for the dual washing course is inputted through the input unit, the first control unit controls the first washing unit to perform washing according to the dual washing course, and outputs a dual control signal corresponding to the dual washing course.

16. The laundry treatment apparatus of claim 1, wherein, when the first and second control units control the first and second washing units to perform washing, the first and second control units control a supply of liquid to first and second washing tubs, respectively, and spin the washing tubs.

17. The laundry treatment apparatus of claim 1, further comprising:

a first memory which stores at least one dual washing course and a first washing unit course; and a second memory which stores at least one dual washing course and a second washing unit course.

18. The laundry treatment apparatus of claim 4, wherein the plurality of preset processes performed by the first washing unit are different from the plurality of preset processes performed by the second washing unit.

19. A laundry machine, comprising:

a first laundry unit;

a second laundry unit;

a user interface configured to receive a user selection of a dual laundry course among a plurality of dual laundry courses in a menu;

a first controller configured to control an overall operation of the first laundry unit and to transmit a signal; and a second controller configured to control an overall operation of the second laundry unit and to receive the transmitted signal from the first controller, wherein the dual laundry course includes a set of first commands for the first laundry unit and a set of second commands for the second laundry unit, and when the dual laundry course is selected, the dual laundry course is performed such that, during performance of the dual laundry course:

the first controller sends the signal and controls the first laundry unit according to the set of first commands, the second controller receives the signal and controls the second laundry unit according to the set of second commands, and a timing of the first and second set of commands is such that at least one of:

the first and second set of commands begin at a same start time, the first and second set of commands end at a same end time, or spin-drying commands of the first and second set of commands are not performed during a same time interval.

20. The laundry machine of claim 19, wherein the menu includes at least one first laundry course and at least one second laundry course, and wherein:

when the user selects a first laundry course which has the set of first commands and selects a second laundry course which has the set of second commands during a predetermined time period, the dual laundry course is performed; and when the user selects the first laundry course and does not select the second laundry course within the predetermined time period, the first controller controls the first laundry unit according to the set of first commands, and if the user selects the second laundry course after the predetermined time period, the second controller controls the second laundry unit according to the set of second commands and independently of the first controller controlling the first laundry unit according to the set of first commands.

* * * * *